US005685667A

United States Patent [19]

Allen

[11] Patent Number: 5,685,667

[45] **Date of Patent: *Nov. 11, 1997**

[54] HIGH PERFORMANCE CONTRA-ROTATING RIDING TROWEL

[75] Inventor: J. Dewayne Allen, Paragould, Ark.

[73] Assignee: Allen Engineering Corporation, Paragould, Ark.

[ * ] Notice: The term of this patent shall not extend beyond the expiration date of Pat. No. 5,480,258.

[21] Appl. No.: 587,014

[22] Filed: Jan. 16, 1996

Related U.S. Application Data

[63] Continuation-in-part of Ser. No. 499,746, Jul. 7, 1995, which is a continuation-in-part of Ser. No. 176,118, Dec. 30, 1993, Pat. No. 5,480,258.

[51] Int. Cl.[6] ..... E01L 19/00; E01L 19/22

[52] U.S. Cl. ..... 404/112

[58] Field of Search ..... 404/96, 97, 112

[56] References Cited

U.S. PATENT DOCUMENTS 5,480,258 1/1996 Allen ..... 404/112

*Primary Examiner*—William P. Neuder

*Attorney, Agent, or Firm*—Stephen D. Carver; Trent C. Keisling

[57] ABSTRACT

A high power, contra-rotating, twin engine riding trowel for finishing concrete comprises twin, downwardly projecting rotors that counter-rotate simultaneously. An operator sits in a seat mounted to the frame and steers the rotors with a pair of primary control levers that tilt the rotors to generate steering forces. The engines counter-rotate while establishing generally coaxial, horizontal axes of rotation. Each engine drives a rotor through a driveshaft. Both driveshafts establish generally coaxial axes of rotation that are generally parallel to the axes of rotation of the engines. Each driveshaft extends to a gearbox to transfer power to the rotor. The gearboxes are interchangeable and mounted to tiltable, pivotable steering boxes secured to the frame. A first reversing linkage couples the lever means to the arm means. A second reversing linkage means is suitably coupled to one rotor gearbox to reverse tilt it for steering. In combination, the first and second reversing linkages facilitate contra blade rotation, while maintaining stability and trowel control.

15 Claims, 7 Drawing Sheets

HIGH PERFORMANCE CONTRA-ROTATING RIDING TROWEL

CROSS-REFERENCE TO RELATED APPLICATION

This application is a Continuation-in-Part of my prior U.S. application Ser. No. 08/499,746, filed Jul. 7, 1995, GAU 3506, entitled: Precision Steering Twin Engine Rotor-Steered Riding Trowel, which was a Continuation-in-Part of my prior application Ser. No. 08/176,118, filed Dec. 30, 1993, GAU 3506, entitled: Variable Width Twin Engine Riding Trowel, which issued as U.S. Pat. No. 5,480,258, on Jan. 2, 1996.

BACKGROUND OF THE INVENTION

I. Field of the Invention

The present invention relates generally to riding trowels used for finishing concrete surfaces. More particularly, the present invention relates to high powered, motorized riding trowels that are supported and steered by downwardly projecting, tiltable rotors. Known, representative self-propelled riding trowels are classified in United States Patent Class 404, Subclass 112.

II. Description of the Prior Art

As will be recognized by those skilled in the art, motorized trowels can effectively finish large surface areas of wet concrete. Motorized riding trowels are particularly effective in this regard. Motorized "push trowels" and riding trowels often employ revolving rotors that directly contact the concrete surface. The rotors typically comprises a plurality of radially spaced apart finishing blades that revolve in frictional contact the with concrete surface. The rotors support the entire weight of the trowel. While a wide variety of manually pushed troweling machines or "power" trowels are currently used in the industry, self propelled riding trowels efficiently finish large areas of concrete more swiftly than motorized "push trowels."

During trowel finishing operations, the trowel must traverse the concrete surface several times as the concrete sets, and generally the more powerful the trowel, the faster the operation can be completed. In relatively recent years motor powered riding trowels have become popular. With riding trowels descended from Holz U.S. Pat. Nos. 4,046,484 and 3,936,212, steering and control is effectuated by the combination of rotor tilting and blade twisting. The rotors are driven by a self contained engine mounted on the frame that is linked to rotor gearboxes. A driver seated above the frame steers the trowel by tilting the axis of rotation of the rotors. The pitch of each trowel blade adjusts by pivoting about its longitudinal axis. A yoke controlled bearing assembly is often employed to vary the blade pitch.

Riding trowels typical of those present in the art are disclosed in two patents issued to Holz, U.S. Pat. Nos. 4,046,484 and 3,936,212. The latter patent depicts a three rotor trowel and a two rotor alternative embodiment wherein the rotors appear to sweep concrete outwardly. The former patent depicts an early twin rotor trowel wherein the rotors sweep the concrete inwardly. However, all of the embodiments shown in the patents are powered by a single motor.

I have been involved with several prior motorized trowel inventions. U.S. Pat. No. 5,108,220 relates to a fast steering system for riding trowels. It discloses a state of the art steering system for riding trowels that enhances maneuverability and control. U.S. Pat. No. Des. 323,510 also discloses a riding trowel.

Kikuchi, U.S. Pat. No. 4,775,306, discloses a multiple engine trowel that does not use the rotors for propulsion or steering. This device is not the type of trowel pioneered by Holz listed above. A pair of drum-like crawlers are separately employed to support the trowel, and they are powered for locomotion. The blades define a wiping annulus upon the concrete surface that circumscribes the crawlers. An unfinished area within the wiping blade perimeter results, and energy is wasted as the frictional contact of the blades is merely dissipated as heat rather than providing propulsion or steering.

Most current riding trowels in the Holz species employ at least two sets of bladed rotors. The sweep areas of the rotor blades often overlap to avoid intermediate seams or surface blemishes. In other words, the propeller-like blades often mesh or almost mesh to avoid unfinished boundary strips. With relatively larger diameter surface finishing pans, no overlap occurs. Typically such rotors must rotate near or at the same speed to minimize or prevent blade collisions. Known current trowels use a single engine to ensure that the rotors are properly synchronized. However, a relatively slow finishing speed results from the low power output of small single engine designs. Since concrete must be finished before setting, the finishing speed of the trowel is important.

At very large pour cites it is often difficult to finish all of the concrete surface area before the concrete significantly sets. Thus more powerful riding trowels are continually evolving. As a result, typical single engine machines are being equipped with more and more powerful engines.

However, bigger engines can result in problems. Very large engines make severe structural demands on the frame, the rotors and the drive train. Obviously, since the rotors are in direct wiping contact with the concrete surface being treated, a typical twin rotor trowel is already under considerable stress. One problem is caused by the transmission of vibrations from the blades to the dynamic components and drive train of the trowel. Vibrations can easily damage the engines, which are expensive to repair. Further, since counter-rotating rotors are typical, preservation of mechanical symmetry in the critical motor-to-rotor gearbox system with a single engine is a challenge yet to be solved.

On multiple rotor trowels, it is desirable to substantially isolate the individual rotors and their gearboxes from the other rotors and gearboxes. Therefore, when one rotor or gearbox breaks, the other rotors and gearboxes are hopefully undamaged. However, single engine designs are deficient in this respect. For example, damaging stresses resulting from impact of one rotor with an "immovable object" are often transmitted to the other rotor drive train with typical older designs.

Obviously trowel breakdown during critical concrete setting necessitates immediate repairs at the job sight. Since one of the most routinely troublesome components is the gearbox, an interchangeable gearbox that would fit any of the rotors on a multiple rotor trowel would diminish down time. An interchangeable gearbox would correspondingly decrease the quantity of spares that must be kept in stock for repairs.

To minimize problems with powerful self-propelled riding trowels, I previously proposed a twin engine design in my patents referenced above. I have also proposed, in my prior application referenced above, an improved engine mounting scheme, power train, and overall design for maximum reliability. In this application, I have provided a new steering system that is more efficient than the system disclosed in my earlier patents. The new system reverses the prior steering forces applied by operators while maintaining the same directional controls. The new system also fine-tunes the engagement "throw" of the levers to increase steering precision.

One of the features of my new steering system involves reversed rotor directional sweep during normal finishing operations. Most known prior art riding trowels rotate their rotors inwardly during forward finishing operations. In other words, the prior rotors press incoming, unfinished concrete inwardly toward the center of the trowel and each other as the trowel travels forwardly. However, I have reversed the sweep of the rotors during forward finishing operations so that the rotors rotate outwardly away from one another. Thus, my system presses incoming, unfinished concrete outwardly toward the trowel periphery as it travels forwardly.

SUMMARY OF THE INVENTION

The instant riding trowel has been designed to maximize horsepower and speed while preserving reliability and control. The present design allows an operator to efficiently finish a large area of plastic concrete. The trowel uses two engines to substantially independently distribute its inherently higher horsepower. Because power is distributed from two separate engines through separate, substantially disparate drive train halves, the chances that forces impacting one blade or rotor can damage the opposite blade or rotor are minimized.

The preferred trowel comprises a rigid metal frame that mounts separate high-power, preferably internal combustion engines. Because the engines are symmetrically spaced apart upon the frame, a dynamic balance is achieved that contributes to ease of use and steering control. Each engine drives a bladed rotor in contact with the concrete surface that counter-rotate simultaneously. A guard cage mounted to the frame prevents inadvertent contact between the rotors and foreign objects.

The seated driver steers the trowel with primary control levers that tilt the rotors to generate steering forces. The longitudinal pitch of the blades on each rotor is also adjustable. Other controls available to the operator include engine switches and gauges. Illumination may be provided by lights mounted on the frame.

Each engine slidably mounts a generally parallelepiped block attached to the frame. The engines counter-rotate while establishing generally coaxial axes of rotation. Each engine drives a pulley. Each pulley drives several fan belts that cooperatively turn a drive shaft. Each engine may be slightly adjusted to tension the belts while maintaining the overall coaxial alignment of each axis of rotation. Both drive shafts cooperatively establish generally coaxial axes of rotation that are generally parallel with the axes of rotation of the engines. The drive shaft and respective belts operationally connect a gearbox to the engine. Each drive shaft extends between the gearbox and the belts. U-joints on each of the drive shafts permit the gearbox and the rotor to move relative to their respective engine. The fan belts and the U-joints cooperatively prevent sudden shocks from being transmitted from the blades to the engines.

Preferably, the gearboxes are interchangeable to promote efficiency when servicing the trowel. The gearboxes are mounted to tiltable, pivotable steering boxes secured to the frame by a top plate. A rotor is secured to a shaft extending downwardly from each gearbox. Several equidistantly spaced blades extend radially outward from each rotor. The blades frictionally contact the concrete surface to be finished while supporting the trowel and operator.

The pitch of the blades attached to each rotor may be varied by a tubular handle assembly or electric linear actuator. The handle or actuator is connected to a cable extending to a pivoting fork which contacts and actuates a swash plate. Arms extend from each rotor blade. The swash plate deflects the arms to vary each blade's pitch by twisting them radially about their longitudinal axis. The pitch of the blades determines the finishing pressure applied to the concrete surface. Portions of the steering system are described in part in my prior U.S. Pat. No. 5,108,220 that relates to a fast steering system for riding trowels, which is hereby incorporated by reference. Preferably a pair of parallel lever arms beneath the frame are connected to the driver's primary control levers. However, unlike the steering system in my prior patent, each arm is not directly connected to each control lever by a simple shaft arrangement. Instead, the control levers connect to a more complex reversing linkage. The reversing linkage redirects the force transmitted by the lever 180 degrees. In other words, pushing forces become pulling forces and vice-versa. The reversing linkage accommodates the reversed rotational direction of the rotors. The shafts themselves have also been shortened to fine-tune the steering precision. The shorter shafts decrease the "throw" necessary to effectuate steering adjustments and increase the efficiency of the operator's efforts.

Also, instead of a straight shaft simply connecting the operator's lever to the tertiary linkage, a reversing linkage is splits the connecting shaft. This second reversing linkage works like the reversing linkages between the levers and the arms. In other words, pushing forces become pulling forces and vice-versa because of the transpositional operation of the reversing linkage.

Each arm still connects to a torque rod that is coupled to a gearbox and the tertiary linkage still controls one of the rotors as discussed in the prior patent. A synchronizer, preferably associated with the throttle, controls the engines. The synchronizer ensures that the engine low idle and high speeds are generally matched.

Therefore, it is a primary object of my Precision Steering Riding Trowel is to provide a dynamically-balanced trowel that finishes a large area of concrete efficiently and quickly.

Another object of the present invention is to provide a trowel of the character described that is inherently stable and easy to control and steer.

Another object is to provide a trowel that is well suited for use on confined job sites.

Another object of the present invention is to provide a trowel that uses multiple engines to simultaneously rotate multiple rotors to finish concrete.

A basic object of the invention is to provide a multiple engine and multiple rotor trowel that distributes engine weight and power evenly to each rotor.

More particularly, it is an important object of my new riding trowel to distribute engine weight virtually directly upon each corresponding rotor so that steering and control are not abrogated by unbalanced engine forces directed to the rotors and acting upon the frame.

Yet another important object is to provide a multiple motor trowel wherein each rotor gearbox is independently driven.

A related object is to provide a multiple motor trowel that tends to isolate each rotor from shocks experienced by the other.

Another basic object of the present invention is to provide a riding trowel that increases production.

A related object is to provide a riding trowel that is particularly well suited for use on quick curing concrete jobs.

Another basic object of the invention is provide interchangeable gearboxes to prevent breakdowns and promote efficient service of the trowel.

Yet another basic object of the present invention is to provide a multiple engine trowel wherein the rotors rotate oppositely and outwardly as the trowel moves forwardly.

A related object of the present invention is to provide a multiple rotor trowel wherein the rotors function individually.

An object of the invention is to provide a sectioned driveshaft that permits the gearbox to move relative to the engine to prevent vibrations from being transmitted from the rotors to the engine.

Another object of the present invention is to provide a multiple engine trowel wherein the rotors function individually.

Yet another basic object of the present invention is to provide a multiple rotor, multiple engine trowel wherein the rotors press incoming concrete toward the trowel periphery during forward movement.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
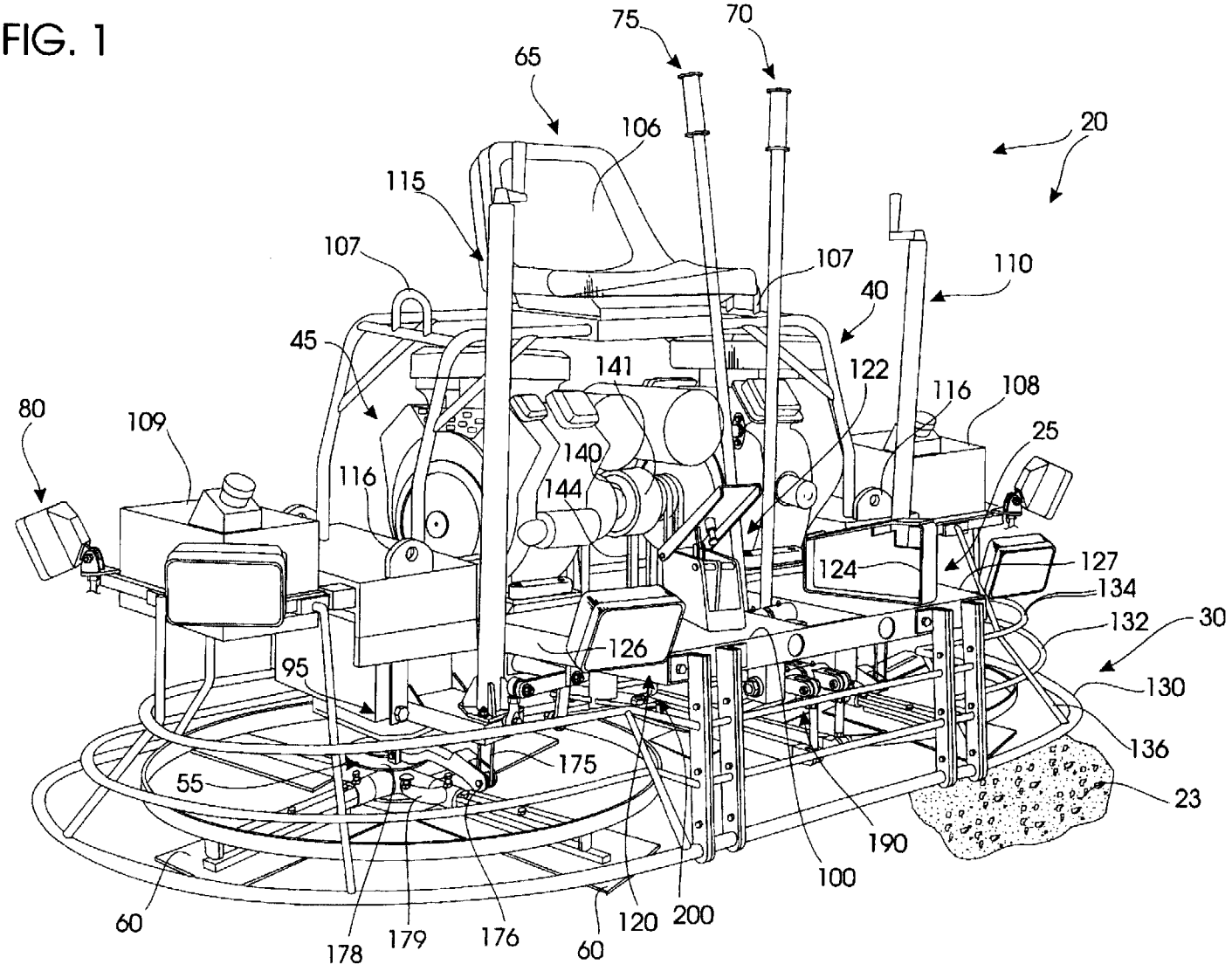
FIG. 1 is a front, environmental, isometric view of my new riding trowel showing the best mode of it known to me as of this date.

With attention now directed to the accompanying drawings, my Precision Steering Riding Trowel is broadly designated by the reference numeral 20. The trowel 20 comprises a metal frame 25 surrounded by a guard cage 30 (FIGS. 1–8) that is supported above a concrete surface 23 to be finished by a pair of rotor assemblies 50, 55. The frame 25 mounts a pair of displaceable engines 40, 45 that drive counter-rotating, rotor assemblies 50, 55. The engines 40, 45 also counter-rotate. The axis of rotation of each engine 40, 45 is generally coaxial with the other. Each of the engines 40, 45 is journalled to one of the rotor assemblies 50, 55, respectively.

Several radially spaced apart blades 60 extend outwardly from each of the rotors 50, 55. The blades 60 frictionally contact the concrete surface 23 to be finished and support the trowel 20 and the operator. An operator station 65 mounts the top of the frame.

Figure 2:
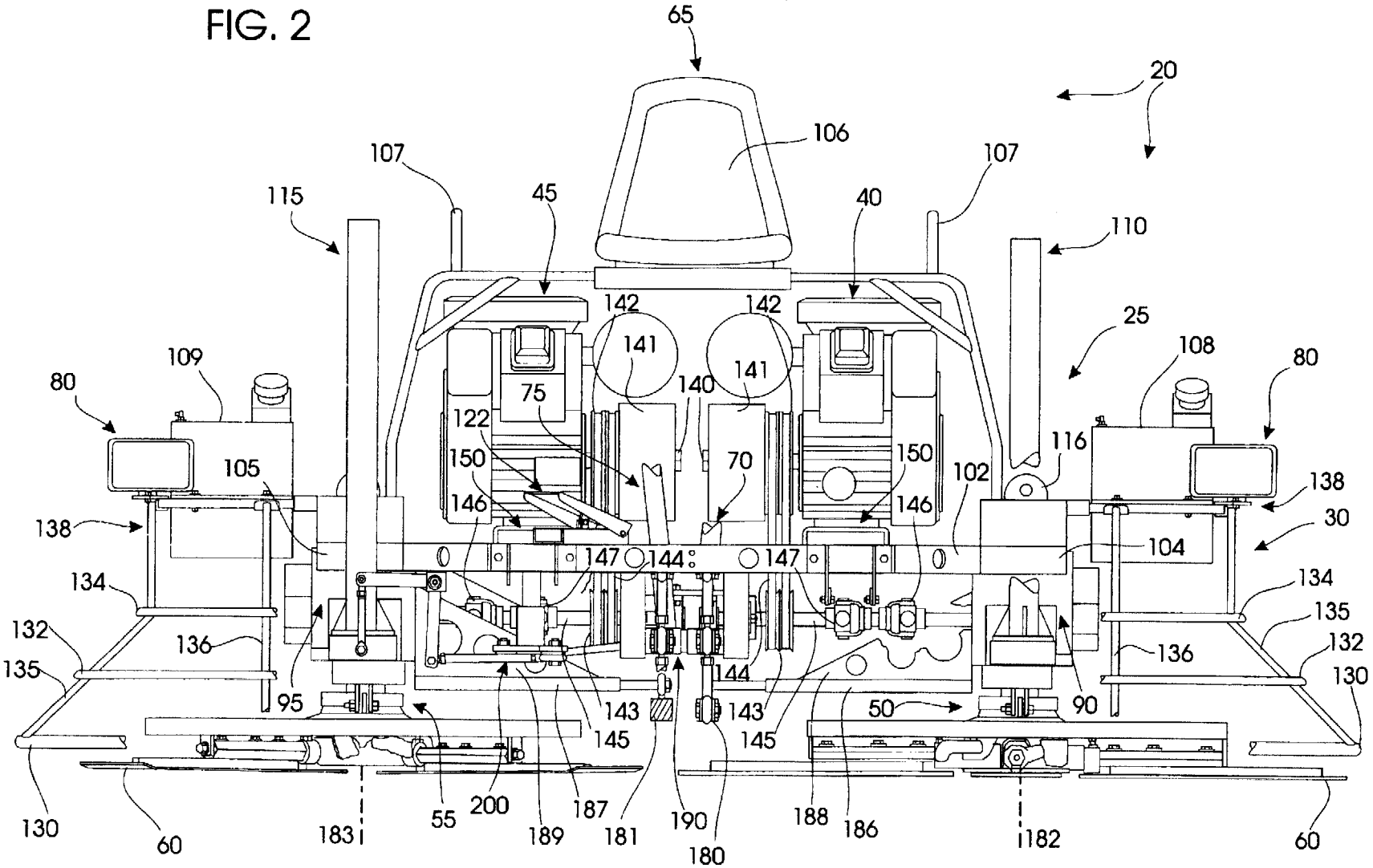
FIG. 2 is a fragmentary front elevational view with portions omitted and/or broken away for clarity.
Figure 5:
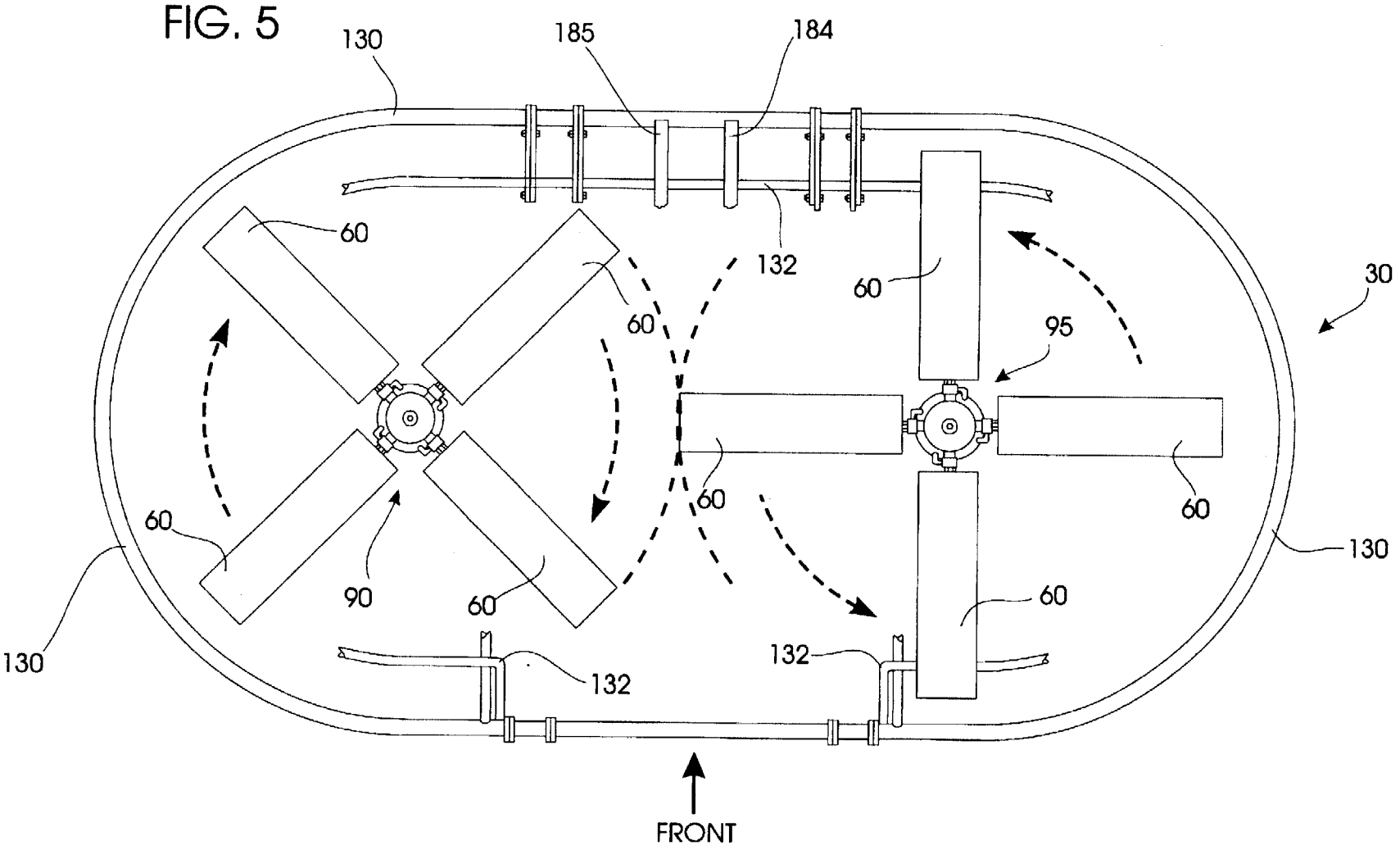
FIG. 5 is a fragmentary, bottom plan view of my trowel illustrating the overlap between sweeps of the rotors, with portions omitted for clarity.
Figure 6:
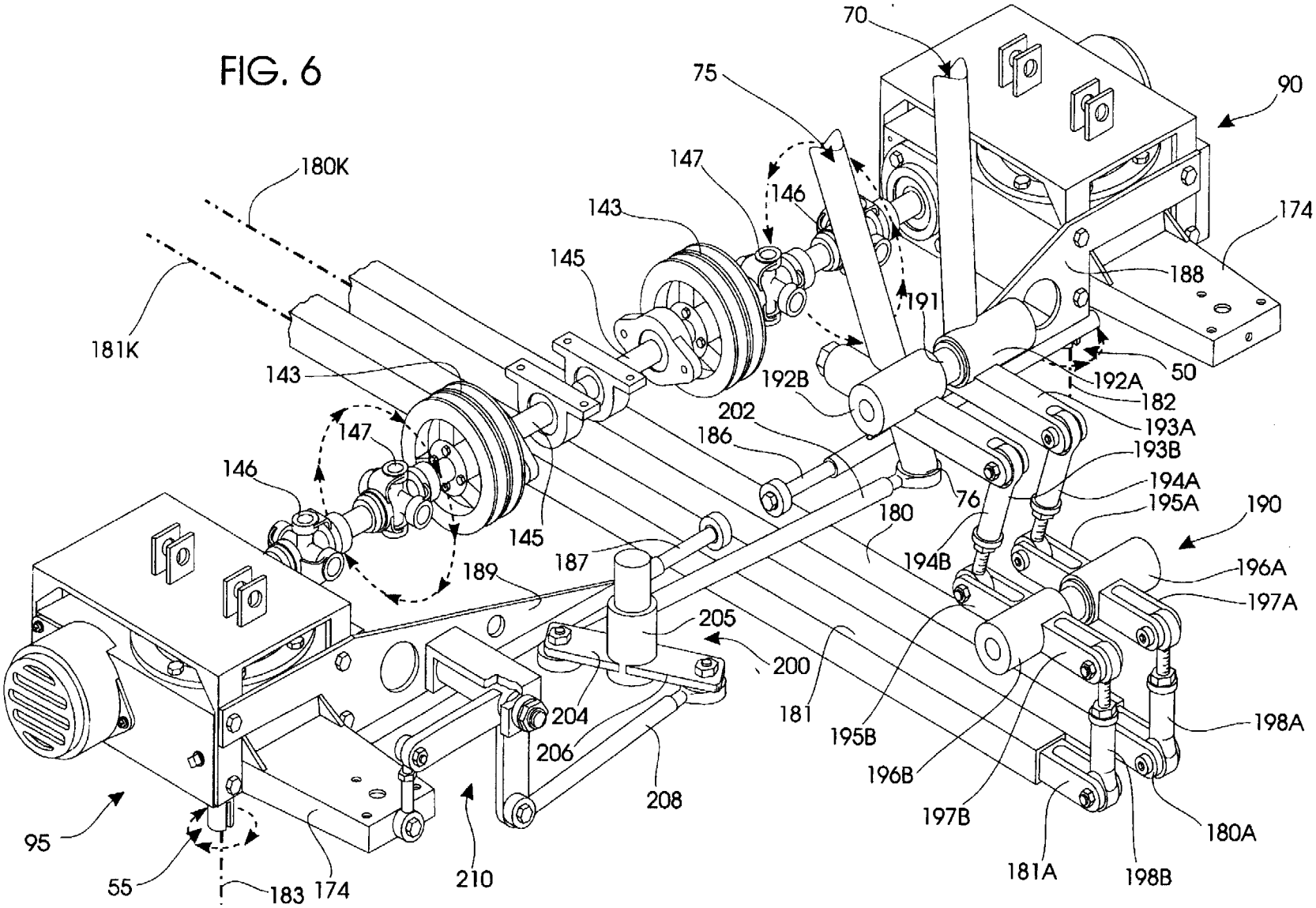
FIG. 6 is an enlarged, fragmentary front isometric view similar to FIG. 6, with portions omitted for clarity, showing the new linkages of the trowel steering and drive train.
Figure 7:
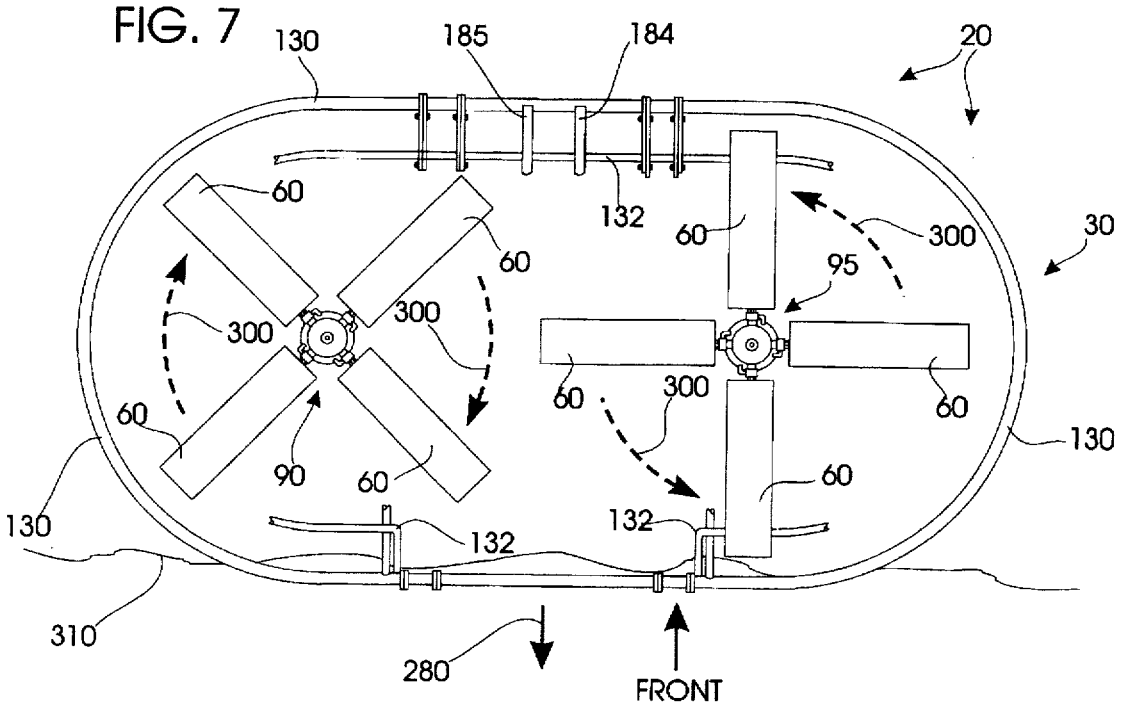
FIG. 7 is a fragmentary environmental view of a preferred embodiment of my trowel as it approaches concrete; and, FIG. 8 is a fragmentary environmental view of a prior art trowel as it approaches concrete.

The controls are easily reached by a seated operator at the station. As viewed by a seated operator, the left rotor 50 revolves in a counterclockwise direction, and the right rotor 55 revolves in a clockwise direction (FIGS. 5, 6 and 7). The operator steers the trowel 20 with two primary control levers 70, 75 (FIG. 1). The levers 70, 75 manipulate gearboxes 90, 95. The gearboxes 90, 95 control the angle or degree of tilt of the rotors 50, 55 to generate steering forces. The longitudinal pitch of each blade 60 may also be manipulated, either manually or electrically, to further control the trowel 20 and the finish imparted to the concrete surface 23 (FIGS. 1 and 2).

Auxiliary lights 80 attach to the frame to provide illumination when necessary. Preferably, the lights bolt to the guard cage 30 to ease their replacement or positioning. Preferably, the guard cage 30 bolts to the frame 25 to facilitate removal or replacement of damaged sections.

The frame 25 comprises an upper deck 100 supported by front and rear frame members 102, 103 and ends 104, 105. The upper deck 100 covers the front and rear members 102, 103. The upper deck provides a mounting surface and a treading platform for an operator. A seat 106 and handholds 107 permit the operator to mount and ride the trowel. Conventional engine controls and gauges (not shown) are conveniently mounted adjacent the seat 106. Two gas tanks 108 and 109 are mounted adjacent the ends 104,105 for convenient fill-ups. Tubular handles 110, 115 or electronic controls are employed by the operator to vary the pitch of the blades 60. Tabs 116 project from the frame to facilitate lifting or transportation of the trowel 20.

A forward subframe 120 projects from the frame 25. It mounts the primary control levers 70, 75, a throttle pedal 122, and a foot rest 124. The throttle peddle 122 controls the flow of fuel from the gas tanks 108, 109 to the engines 40, 45 to ensure that the rotors 70, 55 rotate substantially uniformly. It is important that motor speed be generally the same, but absolute synchronization is not mandatory since the rotor blades do not mesh with one another.

The subframe 120 comprises sides 126, 127 angularly extending forwardly from the front frame member 102. A front cross member 128 defines the front of the trowel. The upper deck 100 also covers the subframe 120.

The guard cage 30 comprises an oval ring 130 that is offset from the concrete surface 22. Reinforcement, guard bars 132, 134 are spaced apart and above the lower ring 130. Radially spaced apart reinforcement spokes 135, 136 extend between the ring 130, bars 132, 134 and frame deck 100. The spokes 135, 136 bolt to the frame with bolts and nuts to ease replacement or removal of sections of the guard 30. The end spokes 135 are coupled to the frame 25 by end assemblies 138 disposed on the ends 104, 105 of the frame 25. Preferably, the end assemblies 138 bolt to the frame with bolts to promote their removal or repair.

The engines 40, 45 are preferably horizontal shaft internal combustion engines. The engines 40, 45 counter-rotate. The axis of rotation of each engine 40, 45 is generally coaxial with the other. Each engine 40, 45 and its respective, coupled gearbox 90, 95 and rotor 50, 55 are mounted similarly. Therefore, only one engine 45 coupled to one gearbox 95 and rotor 55 will be discussed in detail. The gearbox 95 will be discussed in more detail hereinafter.

The output shaft 140 of the engine 45 drives a clutch 141 controlling a pulley 142 (FIG. 2) which is connected to an input shaft pulley 143 by fan belts 144. Belts 144 can slip to prevent engine damage. The belts 144 also permit the engine 45 to be displaced slightly forwardly or rearwardly without altering the driveshaft or gearbox positions. The shaft 140 of each engine 40, 45 establishes an axis of rotation. The axes of rotation of both engines 40, 45 are generally coaxial.

The fan belts 144 extend downwardly from the pulley 142 to a driveshaft 145. Driveshaft 145 extends into the respective gearbox (FIG. 6). The drive shafts counter-rotate with respect to one another to establish an axis of rotation that is generally coaxial with the other driveshaft. The driveshaft axes of rotation are generally parallel to the engine axes of rotation.

The driveshaft 145 is split by two U-joints 146, 147. The U-joints 146, 147 allow slight, operational displacements of the gearbox 95 relative to the input shaft pulley 143. The "slack" in the driveshaft 145 is necessary to help prevent vibrations from being transmitted to the engine 45. Since the blades 60 are generally made of metal, they do not absorb jars or shocks caused when the trowel finishes the concrete.

Figure 4:
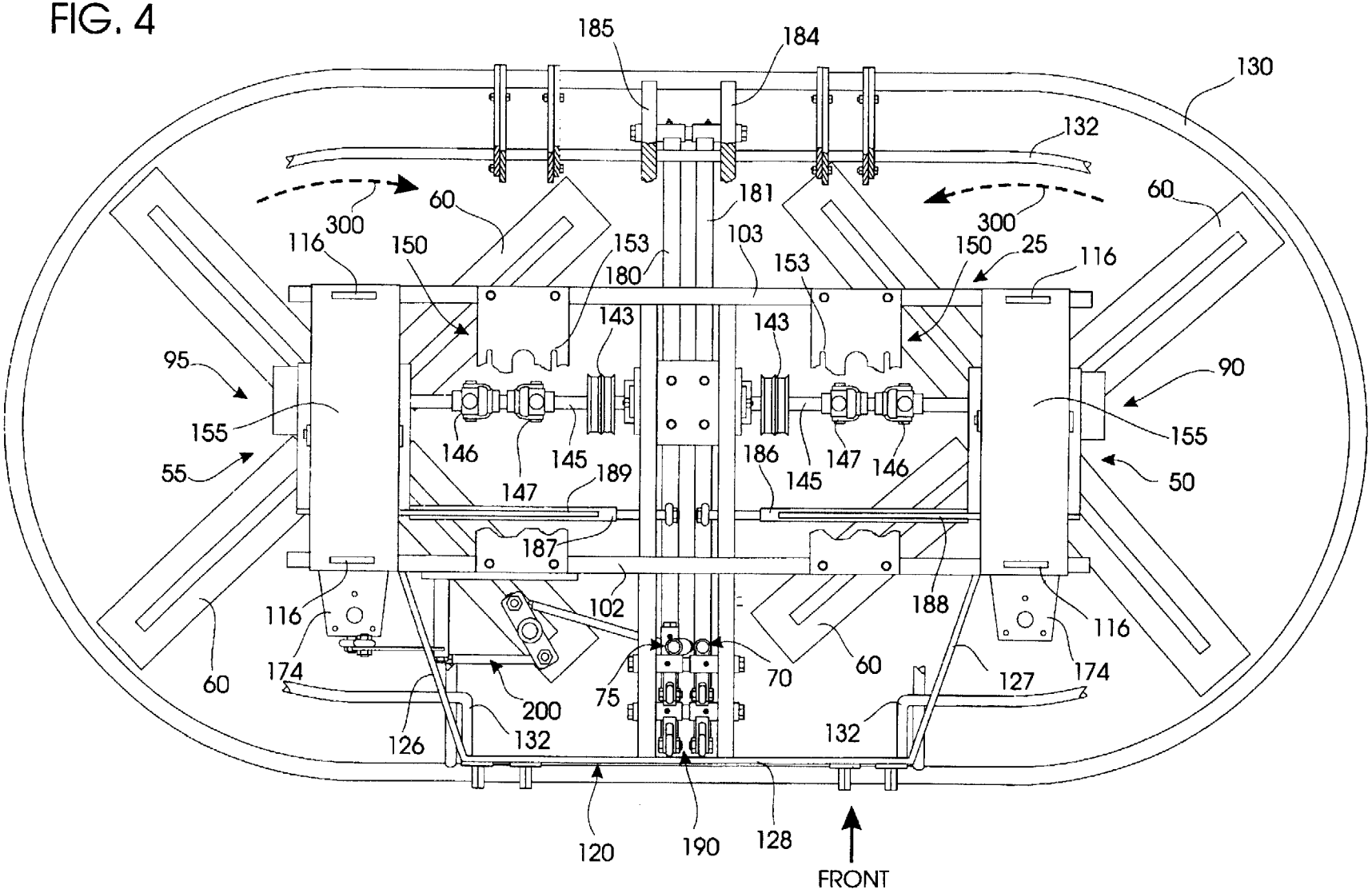
FIG. 4 is a fragmentary, top plan view illustrating the preferred drive train, with portions omitted for clarity.

Engine mount 150 supports engine 45 (FIG. 4). The engine mount 150 secures to front and rear members 102, 103 adjacent end 105. Raised tabs on members 102, 103 secure each mount 150. Slots 153 permit the engine 45 to be displaced forwardly and rearwardly on mount 150 to tension the belts.

A gearbox block 155 secures immediately adjacent end 105. The block 155 is secured to the by a nut and bolt passing through orifices defined in the block 155. The gearbox block 155 is pivotally secured to a generally parallelepiped gearbox top plate. Thus, each gearbox 90, 95 is pivotally mounted to the frame 25. Often the trowel 20 requires on site maintenance. An especially troublesome component on most trowels is the gearbox. Therefore, the preferred gearboxes on trowel 20 are interchangeable. In other words, gearbox 90 and gearbox 95 are substantially identical. This interchangeability means that the trowel may be more efficiently maintained because only one spare must be stocked to service either gearbox.

The preferred steering system is discussed in greater detail in my previous U.S. Pat. No. 5,108,220, the disclosure of which is hereby incorporated by reference with the modifications discussed herein. In the present invention, gearbox 95 is mounted to the underside of block 155 by a tiltable, pivot steering box. How a gearbox tilts is established by connection of its pivot steering box to the block 155, as is fully discussed in U.S. Pat. No. 5,108,220. Preferably, gearbox 95 tilts right to left and front to back, whereas gearbox 90 tilts only left to right. While the pivot steering boxes are structurally identical, they mount each gearbox to the frame differently for steering purposes.

Each rotor 50, 55 is secured to a shaft extending downwardly from each gearbox 90, 95 (FIGS. 1 and 2). Tubular handle assemblies 110, 115 or electric linear actuators, controlled by the operator are employed to vary the pitch of the blades 60, as disclosed in greater detail in the aforementioned patent. These assemblies 110, 115 rest on a ledge 174 extending from the associated gearbox top plate. The assemblies 110, 115 each control a cable 175 extending to a pivoting fork 176 which contacts and actuates a swash plate 178. The swash plate 178 contacts an arm 179 extending from each blade 60, deflecting the blade 60 to the desired pitch.

Figure 3:
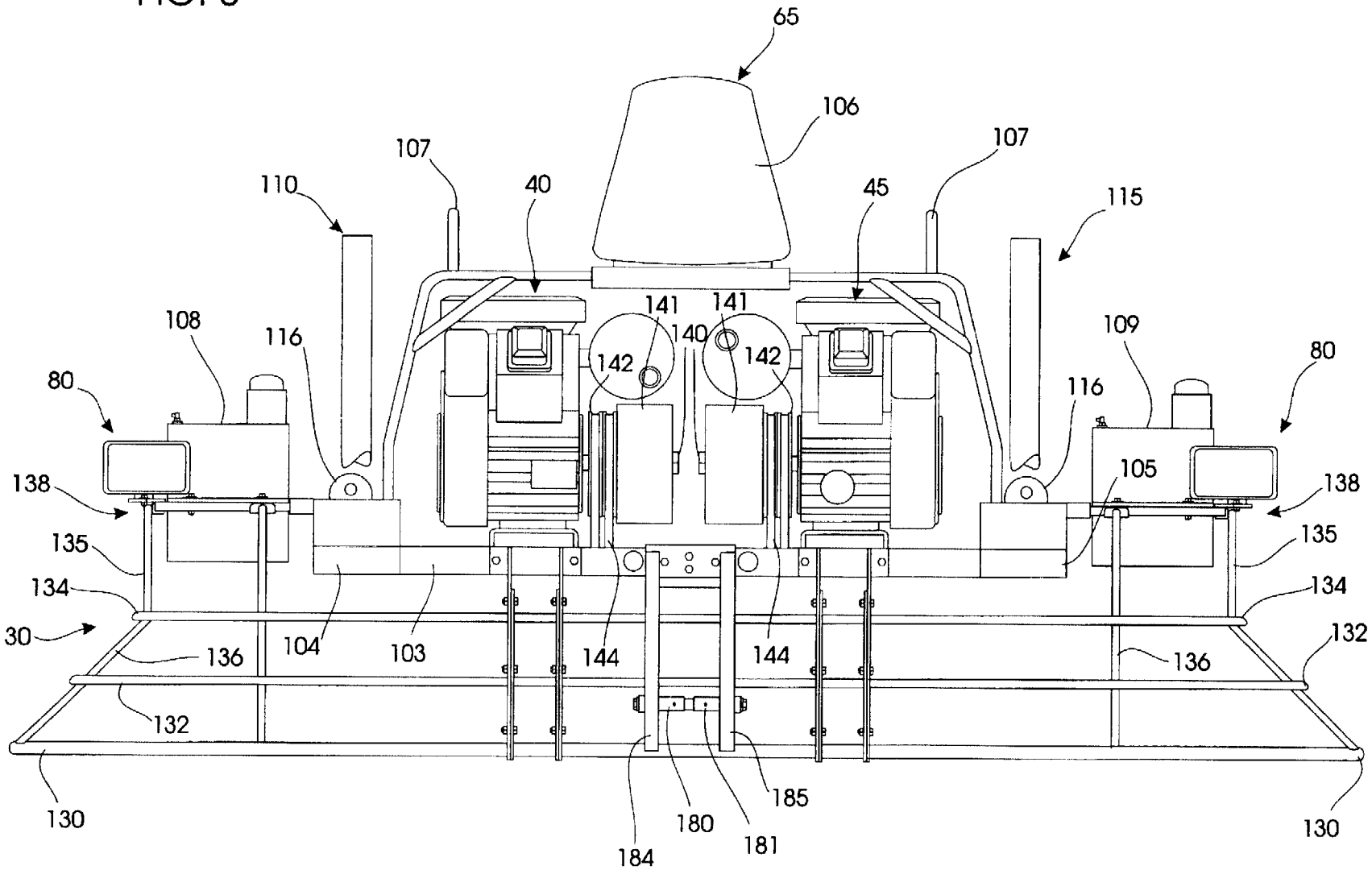
FIG. 3 is a fragmentary rear elevational view, with portions omitted and/or broken away for clarity.

Parallel lever arms 180, 181 extend beneath the frame 25 in a direction generally perpendicular to the biaxial plane defined by the rotor axes 182, 183. The arms 180, 181 are pivotally anchored to inclined struts 184, 185 extending from the rear frame member 103 (FIG. 3). The arms 180, 181 may be deflected by the primary control levers 70, 75 (FIGS. 1–3, 6). Each arm 180, 181 activates elongated torque rods 186, 187 coupled to the gearboxes 90, 95 to tilt the rotors 50, 55 in a plane parallel with the biaxial plane. These arms have a longitudinal axis designated by the reference numerals 180K and 181K (FIG. 6).

The torque rods 186, 187 are generally aligned and extend along the bottom of gussets 188, 189 projecting from the gearboxes. The rods 186, 187 are also offset from the axis of rotation defined within the steering boxes as disclosed in the above referenced patent.

However, unlike the steering system disclosed in U.S. Pat. No. 5,108,220, a first reversing linkage 190 replaces the simple shaft arrangement connecting each lever 70, 75 to each arm 180, 181 (FIG. 6). The first reversing linkage 190 transposes the force transmitted by the levers 70, 75 180 degrees. In other words, pushing forces become pulling forces and vice-versa. The reversing linkage accommodates the reversed rotational direction of the rotors.

Both primary steering control levers 70 and 75 extend through the trowel frame deck 100 to the underside of the frame, for interconnection with the arms 180, 181 respectively. As appreciated from FIG. 6, each lever connects to each arm via reversing linkage 190. Lever 75 can be pushed forwardly or pulled rearwardly, and it may also be moved to the operator's left and right. Lever 70 only moves forwardly or backwardly.

Levers 70 and 75 extend beneath the frame deck 100 where they couple to mandrels 192A and 192B respectively. Two shafts 193A, 193B integrally extend forwardly from mandrels 192A, 192B. The shafts 193A, 193B are preferably welded to each mandrel. The terminal ends of shafts 193A, 193B each receive the upper end of a perpendicularly oriented, adjustable upper tie rod 194A, 194B. The lower, threaded end of each tie rod 194A, 194B couples to the rear, centrally grooved tabs 195A, 195B of mandrels 196A, 196B.

The front, centrally grooved tabs 197A, 197B of each mandrel 196A, 196B couple to the upper end of another perpendicularly oriented, adjustable lower tie rod 198A, 198B. The lower end of each threaded tie rod 198A, 198B attaches to the forward arm ends 180A, 181A.

Moreover, lever 75 does not use the same connection shaft and tertiary linkage arrangement disclosed in U.S. Pat. No. 5,108,220. Instead, lever 75 employs a second reversing linkage 200 that splits the original shaft. Second reversing linkage 200 works similarly to linkage 190. In other words, linkage 200 also transposes transmitted forces 180 degrees. Thus, pushing forces become pulling forces and vice-versa.

Lever 75 terminates beneath the frame in a ball and socket joint 76 at the interior end of connection shaft 202. Connection shaft 202 ultimately transmits a bending moment to gearbox 95 to cause it to tilt in a plane perpendicular with the biaxial plane (the plane established by axes 182 and 183 shown in FIG. 2) for steering purposes.

Connection shaft 202 pivotally attaches at its exterior end to the rear tab 204 of mandrel 205. A pivotally attached connecting link 208 extends from the front mandrel tab 206 to the previously disclosed C-shaped crank 210. The levers 70, 75 steer the trowel 20 as disclosed in U.S. Pat. No. 5,108,220, and the remainder of the steering system works as disclosed therein.

Operation

Figure 8:
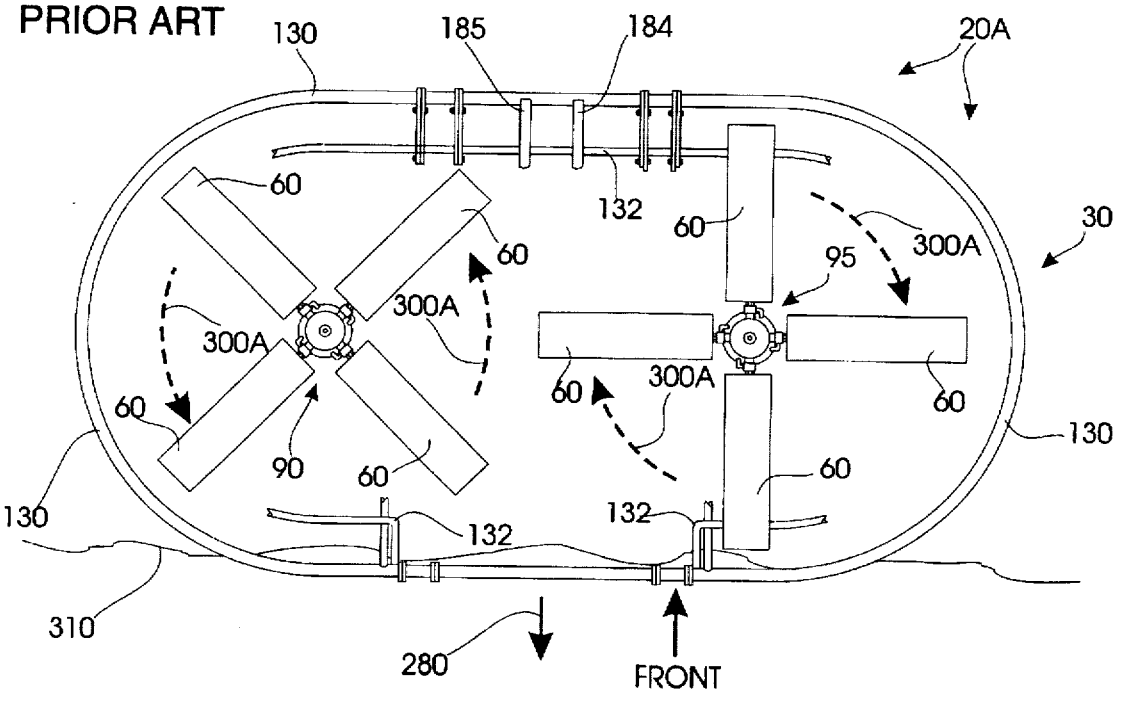
FIG. 8 PRIOR ART

As shown in FIG. 7, one preferred embodiment of my new trowel 20 uses rotors that rotate oppositely to conventional, prior art trowels 20A, shown in FIG. 8. In other words, the directional sweep 300 of the rotors is reversed during normal finishing operations (i.e., when the trowel travels forwardly in the direction indicated by arrow 280) when compared to the directional sweep 300A of prior art rotors.

Most prior art riding trowels rotate their rotors inwardly during forward finishing operations. Thus, when rotating, the rotors sweep new unfinished concrete 310 toward the center of the machine and each other as the trowel travels forwardly (FIG. 7).

The preferred sweep of my new trowel's rotors during forward finishing operations is outwardly as the trowel moves forwardly (FIG. 8). In other words, my system sweeps concrete 310 toward the trowel front and outer sides as it moves forwardly.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A self-propelled, motorized riding trowel with multiple engines for finishing a concrete surface, said riding trowel comprising:

at least two spaced apart motor means for powering said riding trowel;

seat means for supporting an operator of said riding trowel;

control means accessible by said operator from said seat means for steering said riding trowel;

frame means adapted to be disposed over said concrete surface for supporting said seat means, said control means and said motor means;

at least two spaced apart, rotors, each of said rotors driven by and associated with one of said motor means, said rotors adapted to rotate outwardly for contra rotation while frictionally contacting said concrete surface and supporting said frame means thereabove; and, throttle means mounted on said frame means for concurrently controlling said motors to rotate all of said rotors.

2. The riding trowel as defined in claim 1 wherein said control means comprises:

two arms pivotally attached to said frame means, each of said arms coupled to one of said rotors;

two levers adapted to be manipulated by a user; and, first linkage means for connecting said levers to said arms to control the orientation of said rotors in response to user manipulation.

3. The riding trowel as defined in claim 2 wherein said linkage means further comprises a second linkage means for connecting one of said levers directly to one of said rotors.

4. The riding trowel as defined in claim 3 further comprising displaceable motor mount means for adjustably mounting said motors to said frame.

5. The riding trowel as defined in claim 4 including:

a drive shaft projecting from each of said rotors towards one another, the axis of rotation of each drive shaft being substantially coaxial with one another and generally parallel with the axis of rotation of each motor; and, means for rotatably coupling said drive shafts to said motors.

6. The riding trowel as defined in claim 5 wherein said means for rotatably coupling said drive shafts to said motors comprises belt means extending between said motors and said drive shafts and belt tensioning means for tensioning said belts.

7. A self-propelled, dual motor riding trowel for finishing a concrete surface, said riding trowel comprising:

a rigid frame adapted to be disposed over said concrete surface;

seat means on said frame for supporting an operator of said riding trowel;

a pair of spaced apart rotors projecting downwardly from said frame to said surface to support said frame thereabove, each rotor establishing a generally vertical, outward axis of rotation, each of said rotors comprising a plurality of revolving blades that contact and finish concrete, the blades having a longitudinal axis about which they may be rotated to vary their pitch;

a motor disposed upon said frame above each of said rotors for revolving said rotors to finish concrete and propel said riding trowel, each motor establishing a generally horizontal axis of rotation, each axis of motor rotation being substantially colinear with the other;

a separate drive shaft operationally coupling each motor to each rotor, the drive shafts being axially aligned with one another and generally parallel with the axis of rotation of the motors;

belt means interconnecting each motor with a drive shaft to power said rotors; and, control means accessible by said operator from said seat means for orienting said rotors to effectuate steering, said control means comprising:

two parallel arms pivotally attached to said frame means, an arm coupled to each one of said rotors;

two levers adapted to be manipulated by a user; and, first reversing linkage means for connecting said levers to said arms and a second reversing linkage means for connecting one of said levers to one of said rotors, both of said reversing linkage means driven respectively by said levers to control the orientation of said rotors for contra rotation in response to user manipulation.

8. A self-propelled, contra rotating riding trowel for finishing a concrete surface, said riding trowel comprising:

seat means for supporting an operator of said riding trowel;

lever means accessible by said operator from said seat means for steering said riding trowel;

rigid frame means adapted to be disposed over said concrete surface for supporting said seat means and said lever means;

rotor means associated with said frame means and supporting said frame means thereabove, said rotor means comprising a plurality of blades for frictionally contacting said concrete surface, said blades rotating outwardly toward the front periphery of said frame means;

gearbox means for driving said rotor means, said gearbox means comprising a pair of rotatable shafts projecting downwardly from said frame means and together defining a biaxial plane;

motor means associated with said gearbox means for powering said riding trowel;

means for pivotally mounting said gearbox means to said frame means;

drive shaft means for actuating said gearbox means in response to said motor means thereby revolving said rotor means;

arm means rotatably coupled to said frame means for tilting said rotor means in response to said lever means;

torque rod means extending to said gearbox means and driven by said arm means for tilting said rotor means in a plane generally parallel with said biaxial plane;

first reversing linkage means for coupling said lever means to said arm means;

connecting means for tilting one of said rotor means in a plane generally perpendicular to said biaxial plane in response to one of said lever means to effectuate steering and control; and, second reversing linkage means for coupling said connecting means to said gearbox means that is tilted in a plane generally perpendicular to said biaxial plane.

9. The riding trowel as defined in claim 8 wherein said connecting means is interconnected with said one of said rotor means by tertiary linkage means for deriving a mechanical advantage, wherein said tertiary linkage means comprises crank means driven by said reversing linkage means and coupled to said gearbox means.

10. A self-propelled, fast steering contra rotation motorized riding trowel for finishing a concrete surface, said riding trowel comprising:

seat means for supporting an operator of said riding trowel;

lever means accessible by said operator from said seat means for steering said riding trowel;

rigid frame means adapted to be disposed over said concrete surface for supporting said seat means and said lever means;

twin rotor means associated with said frame means for navigating said concrete surface and supporting said frame means thereabove, said twin rotor means comprising a rotor means to the left of a seated operator revolving counterclockwise and a rotor means to the right of a seated operator revolving clockwise, each rotor means comprising:

blade means comprising a plurality of individual radially spaced apart blades adapted to frictionally contact said surface, said blades having a preselected pitch;

gearbox means for outwardly rotating said blade means, said gearbox means comprising a pair of rotatable shafts projecting downwardly from said frame means and defining a biaxial plane; and, means for pivotally mounting said gearbox means to said frame means;

motor means associated with said gearbox means for powering said riding trowel;

flexible drive shaft means for actuating said gearbox means in response to said motor means and thereby revolving said rotor means;

means interconnecting said drive shaft means with said motor means;

arm means rotatably coupled to said frame means for tilting said rotor means in response to said lever means;

torque rod means extending to said gearbox means and driven by said arm means for tilting said rotor means in a plane generally parallel with said biaxial plane;

first reversing linkage means for coupling said lever means to said arm means;

connecting means for tilting one of said rotor means in a plane generally perpendicular to said biaxial plane in response to one of said lever means to effectuate steering and control; and, second reversing linkage means for coupling said connecting means to said gearbox means that is tilted in a plane generally perpendicular to said biaxial plane.

11. The riding trowel as defined in claim 10 wherein said connecting means is interconnected with said one of said rotor means by tertiary linkage means for deriving a mechanical advantage, wherein said tertiary linkage means comprises crank means driven by said reversing linkage means and coupled to said gearbox means.

12. The riding trowel as defined in claim 11 including crank means for varying said pitch of said blades, and wherein said rotor means comprises means for twisting said blades about their longitudinal axis, clutch plate means for actuating said last mentioned means, fork means for selectively actuating said clutch plate means, and cable means interconnecting said hand crank means to said fork means.

13. A self-propelled, contra rotation motorized riding trowel for finishing a concrete surface, said riding trowel comprising:

motor means for powering said riding trowel;

seat means for supporting an operator of said riding trowel;

control means accessible by said operator from said seat means for steering said riding trowel;

frame means adapted to be disposed over said concrete surface for supporting said seat means, said control means and said motor means;

two spaced apart, contra rotation rotors driven by said motor means, a rotor on the left of an operator who is seated and glancing forwardly rotating counter clockwise, the rotor on the right of said operator who is seated and glancing forwardly rotating clockwise, said rotors frictionally contacting said concrete surface and supporting said frame means thereabove; and, means for controlling said motor means to rotate all of said rotors.

14. A self-propelled, dual motor contra rotation riding trowel for finishing a concrete surface, said riding trowel comprising:

a rigid frame adapted to be disposed over said concrete surface;

seat means on said frame for supporting an operator of said riding trowel;

a pair of spaced apart rotors projecting downwardly from said frame to said surface to support said frame thereabove, each rotor establishing a generally vertical, axis of rotation, each of said rotors comprising a plurality of revolving blades that contact and finish concrete, a rotor on the left of an operator who is seated and glancing forwardly rotating counterclockwise, the rotor on the right of said operator who is seated and glancing forwardly rotating clockwise;

a motor disposed upon said frame above each of said rotors for contra rotating said rotors to finish concrete and propel said riding trowel;

means for coupling each motor to each rotor;

control means accessible by said operator from said seat means for orienting said rotors to effectuate steering.

15. A self-propelled, riding trowel for finishing a concrete surface, said riding trowel comprising:

seat means for supporting an operator of said riding trowel;

lever means accessible by said operator from said seat means for steering said riding trowel;

rigid frame means adapted to be disposed over said concrete surface for supporting said seat means and said lever means;

a pair of spaced apart rotors projecting downwardly from said frame to said surface to support said frame thereabove, each rotor establishing a generally vertical axis of rotation, a biaxial plane established between the axis of rotation of the rotors, each of said rotors comprising a plurality of revolving blades that contact and finish concrete, a rotor on the left of an operator who is seated and glancing forwardly rotating counterclockwise, the rotor on the right of said operator who is seated and glancing forwardly rotating clockwise;

gearbox means for driving said rotors;

motor means coupled to said gearbox means for powering said riding trowel;

means for pivotally mounting said gearbox means to said frame means;

arm means rotatably coupled to said frame means for tilting said rotor means in response to said lever means;

offset rod means extending to said gearbox means and driven by said arm means for tilting said rotor means in a plane generally parallel with said biaxial plane;

first reversing linkage means for coupling said lever means to said arm means;

connecting means for tilting one of said rotor means in a plane generally perpendicular to said biaxial plane in response to one of said lever means to effectuate steering and control; and, second reversing linkage means for coupling said connecting means to said gearbox means that is tilted in a plane generally perpendicular to said biaxial plane.

* * * * *